US007568530B2

(12) United States Patent
Haertl

(10) Patent No.: US 7,568,530 B2
(45) Date of Patent: Aug. 4, 2009

(54) GROUND WORKING IMPLEMENT

(75) Inventor: Jakob Haertl, Poettmes (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 0 days.

(21) Appl. No.: 11/635,796

(22) Filed: Dec. 8, 2006

(65) Prior Publication Data

US 2008/0011495 A1 Jan. 17, 2008

(30) Foreign Application Priority Data

Dec. 9, 2005 (EP) ..... 05027009

(51) Int. Cl.
*A01B 5/08* (2006.01)

(52) U.S. Cl. ..... 173/184; 173/90

(58) Field of Classification Search ..... 173/184, 173/90; 405/259.1, 232
See application file for complete search history.

(56) References Cited

U.S. PATENT DOCUMENTS 3,048,237 A * 8/1962 Rutherford ..... 187/204
3,126,063 A * 3/1964 Pitt et al. ..... 173/152
3,460,638 A * 8/1969 Millsapps, Jr. ..... 175/85
3,780,816 A * 12/1973 Arrington et al. ..... 173/152
3,850,253 A 11/1974 Lupton et al.
4,315,552 A * 2/1982 Winsor ..... 173/159
5,181,693 A 1/1993 Lorenz et al.
5,431,234 A 7/1995 Klemm
2006/0042811 A1 * 3/2006 Hagemeyer ..... 173/1

FOREIGN PATENT DOCUMENTS

DE 1922486 A1 11/1970
DE 2353106 A1 6/1974
DE 2817017 A1 11/1979
DE 4113422 A1 10/1992
DE 19514288 A1 10/1996
GB 1310268 A1 3/1973
JP 09078971 A 3/1997

* cited by examiner

*Primary Examiner*—Brian D Nash
(74) *Attorney, Agent, or Firm*—Jacobson Holman PLLC

(57) ABSTRACT

The invention relates to a ground working implement, particularly for underground working, having a slide displaceable relative to a base by means of a lifting cylinder arrangement. It is on the one hand connected to the slide and on the other to the base and has two oppositely acting lifting cylinder means. A particularly compact, stable arrangement is brought about in that the two lifting cylinder means have in each case one lifting cylinder with cylinder casing, which are juxtaposed and are firmly interconnected.

9 Claims, 1 Drawing Sheet

GROUND WORKING IMPLEMENT

BACKGROUND OF THE INVENTION

1. Field of the Invention

The invention relates to a ground working implement, particularly for underground working, having, a slide displaceable relative to a base by means of a lifting cylinder arrangement, which is on the one hand connected to the slide and on the other to the base and has two oppositely acting lifting cylinder devices.

2. Description of the Related Art

DE-A-195 14 288 e.g. discloses a drilling implement of the aforementioned type. Said drilling implement has a bilaterally acting hydraulic cylinder for the linear displacement of a drilling drive. Such a tandem cylinder has a through cylinder casing, a lifting piston being extendible from either side. Compared with a single-acting lifting cylinder said tandem cylinder has the advantage of a better flexural stiffness of the lifting piston to be extended as a result of the reduced length of the two lifting pistons to be extended.

As with a single-acting cylinder, in the case of the tandem cylinder the maximum lift length corresponds to the installation or laid length of the lifting cylinder means and as a result the lift height is limited.

JP-A-09078971 discloses a ground working implement with an oppositely acting lifting cylinder arrangement. Two lateral, single-acting lifting cylinders are arranged in offset, displaceable manner with respect to a tandem cylinder. Also with this known lifting cylinder arrangement the maximum lift length is roughly limited to the installation length of the tandem cylinder.

Finally, DE-A-28 17 017 discloses a horizontal press drilling tool, in which a soil auger can be pressed into the soil by means of two main hydraulic cylinders. There are also two auxiliary cylinders, whose lifting pistons are connected to the cylinder casings of the main cylinders so as in this way to achieve an independent movement of the soil auger with respect to a drill tube. Also in this arrangement the maximum lift length is roughly limited to the installation length of the main cylinders.

BRIEF SUMMARY OF THE INVENTION

The object of the invention is to provide a ground working implement which, in the case of a simple, stable construction, allows a maximum displacement movement by means of a lifting cylinder arrangement.

According to the invention this object is achieved by a ground working implement having the features of claim 1. Preferred embodiments are given in the dependent claims.

The implement according to the invention is characterized in that the two lifting cylinder means in each case have at least one lifting cylinder with cylinder casing and which are juxtaposed and firmly interconnected. This leads to a stable and overall compact adjusting device. Compared with a single-acting lifting cylinder, the arrangement according to the invention can achieve virtually double the lift length for the same installation length.

According to a preferred embodiment of the invention the lift cylinders of the two lift cylinder means are identically constructed, which provides the possibility of inexpensive obtaining of identical parts. In particular, the length of the individual cylinder casing or lifting cylinder in the extended and retracted state is the same. This permits an optimum utilization of the overall length compared with the lift height. Preferably at least all the lifting cylinders of one of the lifting cylinder means are identical.

A particularly efficient arrangement is inventively obtained in that the first lifting cylinder means has at least two lifting cylinders and that the second lifting cylinder means has one lifting cylinder, which is positioned centrally to the at least two lifting cylinders of the first lifting cylinder means. The lifting cylinders can e.g. be arranged on a line or in triangular manner with respect to one another. As a result of a single central lifting cylinder and two juxtaposed lifting cylinders it is possible to avoid tilting moments as a result of the offset arrangement. Obviously the first cylinder means can also have three, four or more cylinders, which are arranged in annular manner or uniformly distributed in some other way around the centrally positioned second lifting cylinder means. The second lifting cylinder means can also comprise several lifting cylinders, e.g. a package of two, three, four or more lifting cylinders, said package then being positioned centrally relative to the first lifting cylinder means.

In the case of the arrangement with a central lifting cylinder a preferred development of the invention comprises the central lifting cylinder of the second lifting cylinder means being constructed differently compared with the surrounding lifting cylinders of the first lifting cylinder means. For example the central lifting cylinder can have a stronger lifting power and a more flexurally stiff lifting piston, so that an identical force application and stiffness to the surrounding lifting cylinders is obtained.

According to the invention good installability is achieved in that an adaptor member is provided on which is located on the one hand the at least two lifting cylinders of the first lifting cylinder means and on the other a central connection element. The lifting cylinder means can consequently be connected in the same way as a single hydraulic cylinder. This ensures the possibility of being able to reequip in simple manner existing equipment, so that for the same it is possible to virtually double the displacement path or travel.

It is particularly appropriate according to the invention that the cylinder casings are firmly interconnected by means of at least one rigid support element. The cylinder casings can be detachably fixed by corresponding fixing devices to a plate-like, rigid support. Thus, in simple manner individual lifting cylinders can be exchanged, so that desired lift lengths and controlling forces can be set. On the support element can also be provided a common connection device for the hydraulic supply. This simplifies the supply of hydraulic lines and avoids hindrances and collisions.

An improvement to the stability and flexural stiffness is inventively obtained in that the base has a linear guide on which engages the at least one support element and guides along the same. The additional guide of the support element with the cylinder casings leads to an additional stiffening, which prevents a buckling risk.

According to the invention this embodiment is further developed in that the linear guide is placed on an erectable mast and that the linear guide is constructed for guiding the support element and the slide. It is consequently unnecessary to provide a separate guidance device and instead the support element is also carried along the existing slide guide.

Preferably, according to the invention, there are two plate-like connecting members, which are fixed to the end regions of the cylinder casings. This also improves rigidity. The connecting members can be located on the support element.

It is also advantageous according to the invention to place a ground working tool on the slide. This can in particular be drilling tool and the associated drilling drive or a pile to be pressed in, together with the associated holding or clamping element. Additionally or alternatively a vibrator can be provided on the slide. It is also possible to place on the slide other tools, drives or miscellaneous equipment having to be linearly displaced. The inventive implement with a lifting arrangement can also be used for the most varied purposes, the use of the ground working implement for underground working or for finding mineral resources being particularly preferred. The ground working implement can in particular be a drilling tool and/or a vibrator.

The invention makes it possible to obtain long feed lengths with a limited dead length of the lifting cylinder arrangement. With respect to the force absorption it is particularly advantageous that the lifting cylinders of the two lifting cylinder means run parallel to one another. Appropriately the lifting cylinders also run parallel to the guidance direction of the linear guide and/or the mast. A particularly high flexural stiffness can be obtained in that the lifting cylinders are positioned in rotationally symmetrical manner to the feed direction of the lifting cylinder arrangement.

The invention can be implemented simply with conventional ground working implements in that the inventive lifting cylinder arrangement is located at the articulation point of a known feed cylinder.

DETAILED DESCRIPTION OF THE INVENTION

Figure 1:
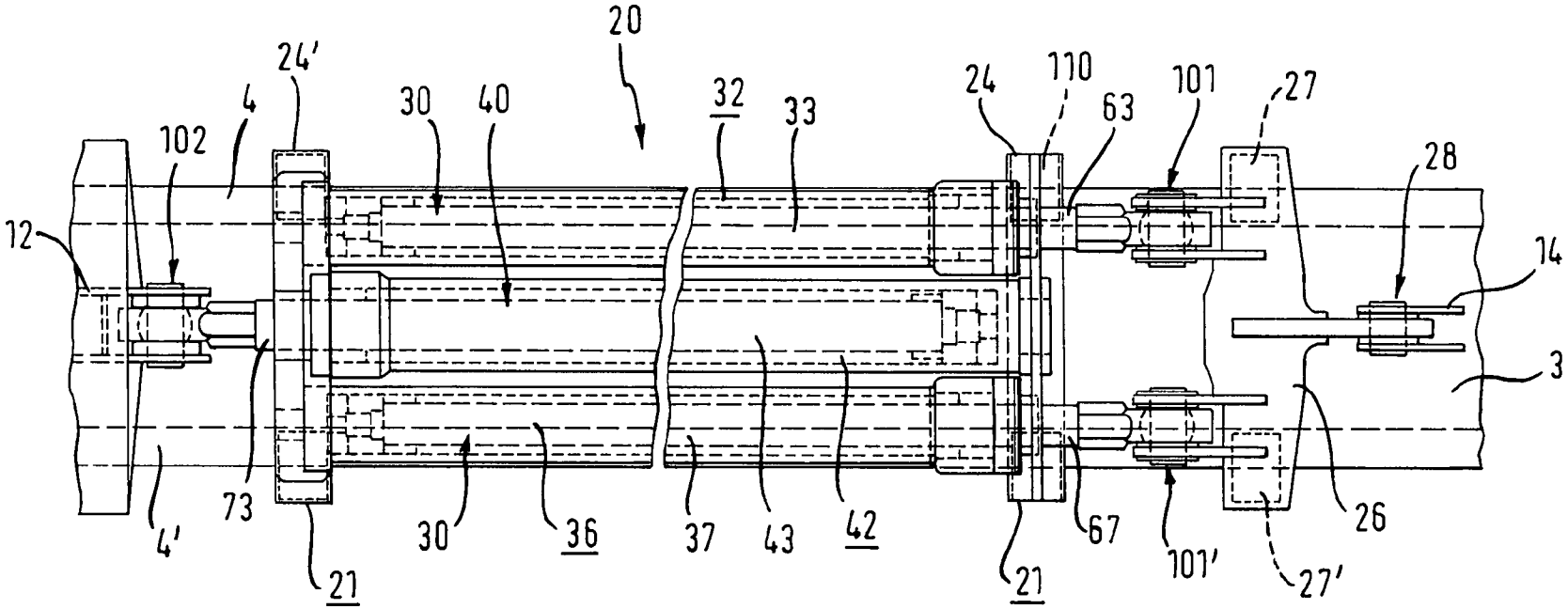
FIG. 1 is a side view of an inventive ground working implement with the lifting cylinder arrangement telescoped.

An embodiment of an inventive ground working implement with lifting cylinder arrangement 20 is diagrammatically shown in a retracted position in FIG. 1. The ground working implement has a slide 12, which is movable relative to a base 14 by means of lifting cylinder arrangement 20. The slide 12 can be used for holding a ground working tool and in particular has a rotary and/or vibrating drive for a ground working tool.

Slide 12 is longitudinally displaceably mounted on a mast 3, which can in particular be constructed as a guide or jib. To this end mast 3 has two marginal, longitudinally directed rail elements 4, 4' on which displaceably engages the slide 12. Base 14, shown in highly simplified form, can e.g. be part of a chassis on which can be also located the mast 3. Base 14 can also be displaceable relative to mast 3.

Lifting cylinder arrangement 20 has a first lifting cylinder means 30 with two first lifting cylinders 32, 36 and a second lifting cylinder means 40 with a second lifting cylinder 42, the first lifting cylinders 32, 36 in each case having a cylinder casing 33, 37 respectively and the second lifting cylinder 42 has a cylinder casing 43. Cylinder casings 33, 37 and 43 of the first lifting cylinder means 30 and the second lifting cylinder means 40 are parallel to one another and are located in one plane, the second lifting cylinder 42 being positioned centrally and equidistantly spaced with respect to the two first lifting cylinders 32, 36. Lifting cylinders 32, 36 and 42 are double-acting and are hydraulically operated by means of a common connection device on a support element 21.

Displaceable lifting pistons 63, 67, 73 run within the cylinder casings 33, 37, 43. The lifting pistons 63, 67 of the first lifting cylinder means 30 are extendible from the corresponding cylinder casings 33, 37 in the direction of the articulation of base 4, to the right in the drawing. Lifting piston 73 of the second lifting cylinder means 40 is extendible in the direction of the articulation point of slide 12 from its cylinder casing 43, to the left in the drawing. Thus, the second lifting cylinder means 40 runs in opposition to the first lifting cylinder means 30.

Lifting pistons 63, 67 of the first lifting cylinder means 30 are connected in displacement-preventing manner to base 14, whereas lifting piston 73 of the second lifting cylinder means 40 is connected to slide 12. For the connection of lifting pistons 63, 67 of the first lifting cylinder means 30 to base 14 frontally on the first lifting cylinders 32, 36 is provided a plate-like adaptor member 26 running transversely to the feed direction and to which are articulated lifting pistons 63, 67 by means of two coaxial bolted joints 101, 101'. Adaptor member 26 constructed as a yoke running transversely to the feed direction is bolted by a bolted joint to base 14 at a central connection element 28. The bolted joint between adaptor member 26 and base 14 is positioned centrally, so that the inventive hydraulic cylinder arrangement in existing equipment can replace a conventional hydraulic cylinder means. Adaptor member 26 has two guide shoes 27, 27' with which the adaptor member 26 is guided in buckling-proof, longitudinally displaceable manner on mast 3. These guide shoes 27, 27' are in each case in engagement on one of the rail elements 4, 4'. For this purpose the rail elements 4, 4' can have a longitudinally directed groove in which the guide shoes 27, 27' engage.

Lifting piston 73 of the second lifting cylinder means 40 is detachably fixed by a further bolted joint 102 to slide 12.

Cylinder casings 33, 37 and 43 of the two lifting cylinder means 30 and 40 are firmly interconnected by means of two connecting members 24, 24' which in the embodiment shown form the support element 21. Connecting members 24, 24' are constructed as yokes running transversely to the feed direction and which are placed on the two front sides of the cylinder casings 33, 43, 37. The connecting members 24, 24' are also guided on mast 3 so as to be displaceable in the feed direction, i.e. in the longitudinal direction of mast 3. For this purpose the connecting members 24, 24' in each case have two guide shoes, which can be constructed in similar manner to the guide shoes 27, 27' of adaptor member 26. For example, one of the guide shoes of connecting members 24, 24' is given the reference numeral 110 in the drawing. The guide shoes 110 of connecting members 24, 24' form a rear guide device through which the support element 21 can be guided like slide 12 on mast 3.

Besides the connecting members 24, 24' the slide-like support element 21 can have additional support plates in which are received in displacement-resistant, but releasable manner cylinder casings 33, 37, 43. These support plates can e.g. be constructed as crossbars with passage openings for the cylinder casings 33, 37, 43.

Connecting member 24 has two openings through which run the lifting pistons 63, 67 of the first lifting cylinder means 30. The second connecting member 24', to the left in the drawing, has an opening for lifting piston 73 of the second lifting cylinder means 40.

The invention claimed is:

1. A ground working implement for underground work, the ground working implement having a mast and comprising:

a base positioned on the mast;

a slide displaceably mounted on the mast, the slide being displaceable relative to the base; and a lifting cylinder arrangement being connected to the slide and the base for displacing the slide relative to the base, the lifting cylinder arrangement having a first lifting cylinder means having at least two lifting cylinders each with a cylinder casing and a lifting piston displaceable within the cylinder casing, and a second lifting cylinder means having a third lifting cylinder with a third cylinder casing and a third lifting piston displaceable within the third lifting cylinder casing, the pistons of the first lifting cylinder means displaceable in a direction which is the opposite of the direction of displacement of the third piston, the cylinder casings being juxtaposed and interconnected, and wherein the one lifting cylinder casing of the second lifting cylinder means is placed centrally with respect to the at least two lifting cylinder casings of the first lifting cylinder means, an adaptor member movably mounted on the mast, on which are placed the at least two lifting pistons of the first lifting cylinder means and a central connection element, for connecting the adaptor member to the base.

2. Ground working implement according to claim 1, wherein the lifting cylinders of the two lifting cylinder means have the same construction.

3. Ground working implement according to claim 1, wherein the centrally placed lifting cylinder of the second lifting cylinder means has a different construction than the at least two lifting cylinders of the first lifting cylinder means.

4. Ground working implement according to claim 1, further comprising a rigid support element displaceably mounted on the mast and wherein the cylinder casings of the first and second lifting cylinder means are fixed to the rigid support element.

5. Ground working implement according to claim 4, wherein the base has a linear guide on which the rigid support element is guided longitudinally on the mast.

6. Ground working implement according to claim 5, wherein the linear guide is located on the mast and the linear guide is constructed for guiding the rigid support element and the slide.

7. Ground working implement according to claim 1, wherein each of the cylinder casings have end regions and the ground working implement further comprises two plate-like connecting members fixed to the end regions of the cylinder casings.

8. Ground working implement according to claim 1, further comprising a ground working tool located on the slide.

9. Ground working implement according to claim 1, wherein the two lifting cylinder casings and the third lifting cylinder casing are essentially in the same plane.

* * * * *